US005531628A

United States Patent [19]

Watkins

[11] Patent Number: 5,531,628

[45] **Date of Patent: *Jul. 2, 1996**

[54] CONFETTI PARTY FAVOR

[76] Inventor: James O. Watkins, 14920 Mt. Nebo Rd., Poolesville, Md. 20837

[ * ] Notice: The term of this patent shall not extend beyond the expiration date of Pat. No. 5,403,225.

[21] Appl. No.: 273,115

[22] Filed: Jul. 11, 1994

Related U.S. Application Data

[63] Continuation-in-part of Ser. No. 51,355, Apr. 23, 1993, Pat. No. 5,352,148.

[51] Int. Cl.[6] ..... A63H 37/00

[52] U.S. Cl. ..... 446/475; 124/5

[58] Field of Search ..... 446/34, 475, 71, 446/75, 76; 222/129; 124/5

[56] References Cited

U.S. PATENT DOCUMENTS

| | | | |
|---|---|---|---|
| 1,122,421 | 12/1914 | Redington et al. | 446/475 |
| 1,153,207 | 9/1915 | Eisenberg | 446/475 |
| 1,491,809 | 4/1924 | Macchia | 446/475 |
| 1,663,679 | 3/1928 | Carpenter | 446/475 |
| 5,338,242 | 8/1994 | Cheng | 446/475 |
| 5,352,148 | 10/1994 | Watkins | 446/475 |

FOREIGN PATENT DOCUMENTS

| | | | |
|---|---|---|---|
| 458472 | 4/1928 | Germany | 446/475 |
| 112599 | 8/1990 | Germany | 446/475 |
| 10850 | 4/1903 | United Kingdom | 446/475 |
| 341784 | 1/1931 | United Kingdom | 446/475 |
| 2275202 | 8/1994 | United Kingdom | 446/475 |

*Primary Examiner*—Sam Rimell
*Assistant Examiner*—Jeffrey D. Carlson
*Attorney, Agent, or Firm*—Ronald B. Sherer

[57] ABSTRACT

A device suitable as a party favor is disclosed for launching confetti in which the confetti is contained in a cup, and the cup is moved rapidly upwardly by the hand and suddenly stopped, such that the momentum of the confetti ejects the confetti out of the cup and upwardly into the air to form a wide dispersion of confetti in the air.

18 Claims, 2 Drawing Sheets

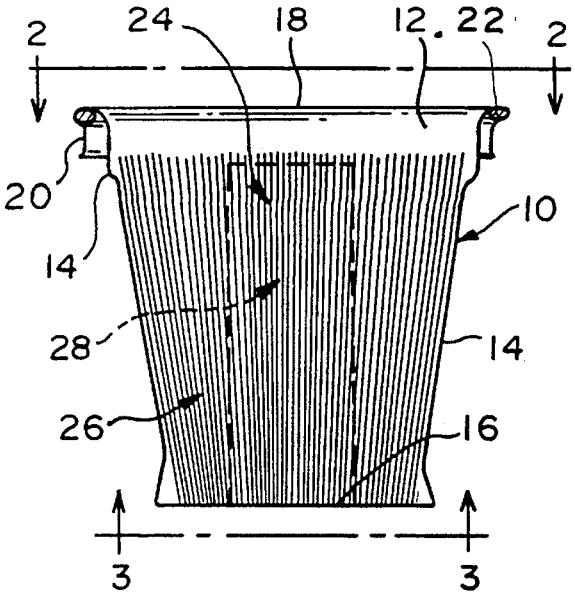
FIG. 1
FIG. 2
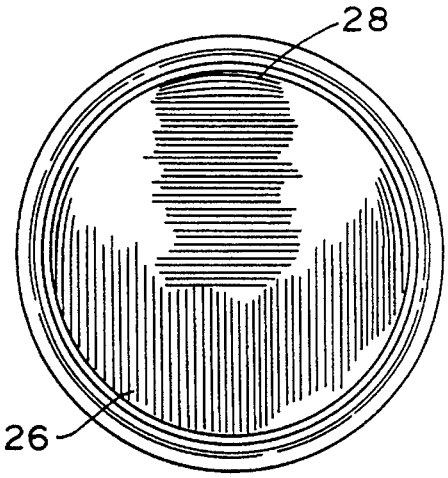
FIG. 3
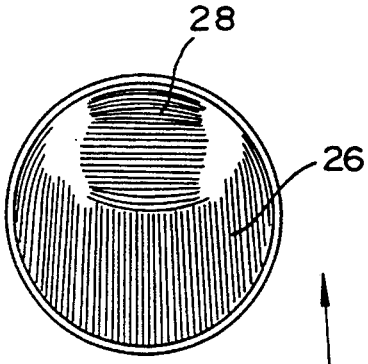
FIG. 5
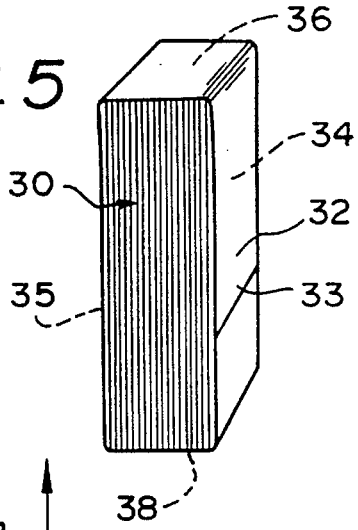
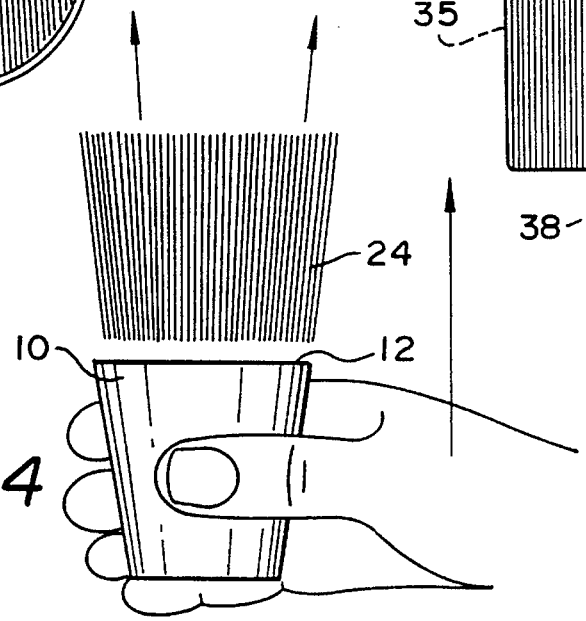
FIG. 4

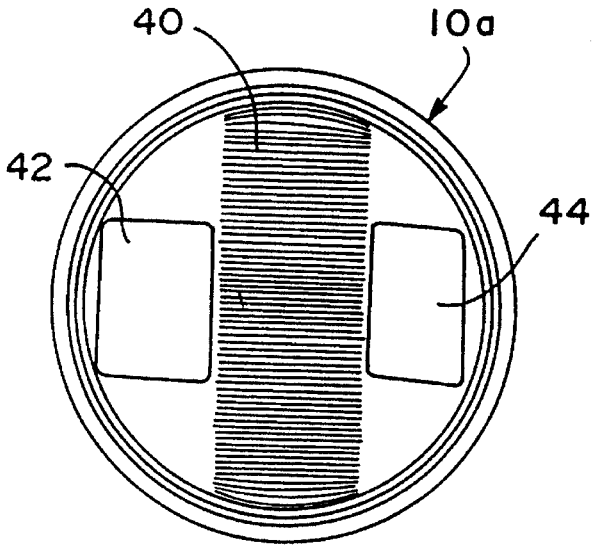
FIG. 6
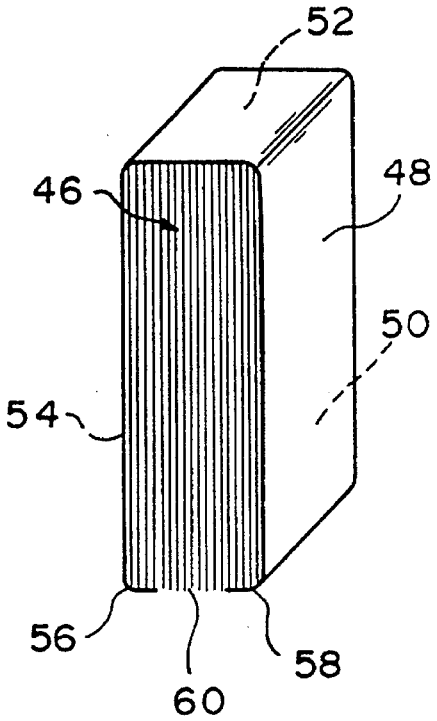
FIG. 7
FIG. 8
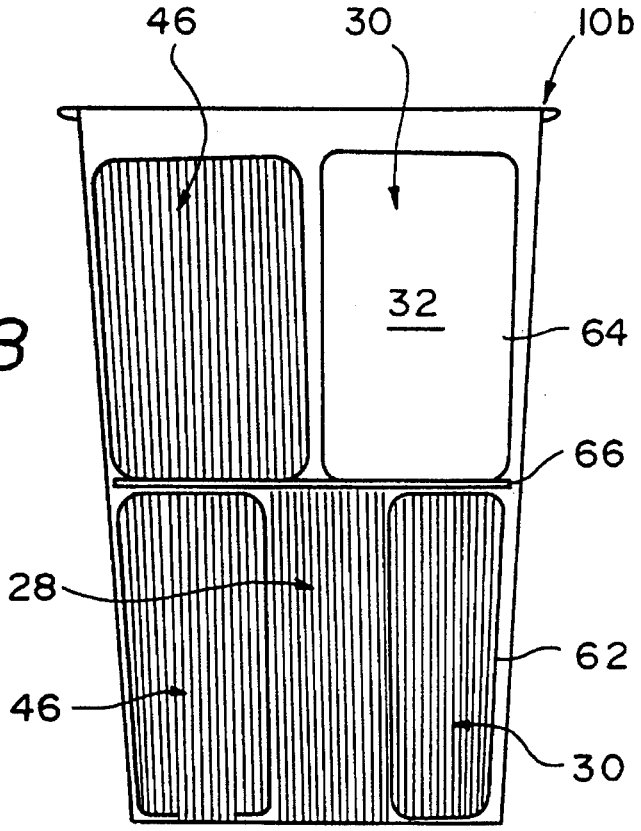

CONFETTI PARTY FAVOR

RELATED APPLICATIONS

This Application is a Continuation-In-Part of application Ser. No. 08/051,355 filed Apr. 23, 1993, now U.S. Pat. No. 5,352,148 the complete specification of which is hereby incorporated by reference.

FIELD OF THE INVENTION

This invention relates to decorative party favors, and more particularly to a decorative party favor which forms a container for confetti, and which favor also functions as an effective launching device for projecting confetti into the air with minimum effort by the user.

BACKGROUND

Party favors are generally known as being decorative gifts which are given to attendees at a wide range of celebrations extending from children's birthday parties to political conventions as well as many other types of festive events. Many types of such party favors are known, and they may be generally characterized as inexpensive gifts which function as decorations at a party table. Preferably, it is also desired that a party favor act as an amusement device of some kind such as, for example, a favor which includes a horn, balloon to be inflated, or a container of candy.

The present invention fulfills all of the desirable attributes of a party favor in that it is decorative, relatively inexpensive, and functions to contain and launch confetti in an extremely easy and effective manner. While confetti has long been used at various types of celebrations, its use has been restricted by the difficulty in launching bulk confetti into the air so as to attain a desired height, and effective dispersion or pattern of the individual pieces, without the use of an explosive or a source of compressed gas. That is, loose or bulk confetti has very little effective mass such that it is very difficult to throw a handful of loose pieces of confetti very far into the air or to achieve a predictable display.

Attempts have also been made to blow confetti out of horns such as disclosed in U.S. Pat. Nos. 1,491,809 and 1,153,207. However, here again, the small, loose pieces of bulk confetti have little or no effective mass such that they do not project very far into the air, and a strong set of lungs are required to achieve any significant dispersion of the individual pieces. Thus, blowing confetti out of a horn or other container is not suitable for either young children or elderly persons, and with any user, the visual effect is extremely limited.

In co-pending application Ser. No. 08/051,355, now U.S. Pat. No. 5,352,148, there is disclosed a unique form of confetti having an elongated tetragonal shape, and in co-pending application Ser. No. 08/080,534, now U.S. Pat. No. 5,403,225, the complete specification of which is hereby incorporated by reference, there is disclosed a method of launching confetti from an elongated, hollow tube; the tube being held at one end and being waved forwardly with the forearm and with a flick of the wrist so as to create sufficient centrifugal force to eject the confetti from the tube. According to the teachings of these co-pending Applications, the confetti may be aligned in stacks such that the stacks of confetti have an effective mass, and as disclosed in the latter co-pending application, the stacks may be ejected from the tube and projected high into the air as stacks such that the rising stacks burst into large and predictable patterns.

Such hollow tubes filled with elongated tetragonal confetti and sold under the trademark Flutter Flicker have had great commercial success, and have been enthusiastically received and used by purchases to launch confetti 20 feet and more into the air. However, a certain degree of dexterity is required in the arm and wrist movement such that very young children and some elderly persons may have some difficulty in obtaining the full trajectory and the optimum burst pattern. At the same time, in the hands of an average adult, even a small 6 inch long tube can easily project the stacks well over 15 feet into the air such that the stacks sometimes hit the relatively low ceilings in residences or party rooms before the stacks have burst fully open thereby producing less of a dispersion pattern than they are capable of producing.

SUMMARY

The present invention solves the above-indicated problems, and comprises an extremely low-cost, decorative party favor which is fun for persons of virtually all ages and degrees of manual dexterity, by providing a cup filled with elongated tetragonal pieces of confetti from which cup the confetti can be launched into the air with a simple, non-strenuous vertical movement of the hand.

The foregoing and other objects and advantages will become more fully apparent from the following description of several preferred embodiments of the invention as illustrated in the following figures of drawing.

BRIEF DESCRIPTION OF DRAWINGS

FIG. 1 is a side cross-sectional view of a cup with a top cover and containing a large plurality of vertically arranged confetti;

FIG. 2 is a top plan view of the cup with the cover of the cup removed taken along view line 2—2 of FIG. 1;

FIG. 3 is a bottom plan view of the cup taken along view line 3—3;

FIG. 4 is a schematic illustration of several bundles of confetti being launched into the air from a hand-held cup.

FIG. 5 is a perspective view of one form of wrapped bundle of confetti which may be launched from the cup;

FIG. 6 is a top plan view of the cup containing an alternate arrangement comprising both wrapped and unwrapped bundles of confetti;

FIG. 7 is a perspective view of a partially wrapped bundle of confetti which may be launched from the cup; and FIG. 8 is a cross-sectional view of an alternate embodiment showing a larger cup with a plurality of layers of stacks of confetti.

DETAILED DESCRIPTION

FIG. 1 illustrates a cup 10 which may be composed of paper or plastic; translucent or clear plastic being preferred so that the multi-colored confetti can be seen through the cup. While a wide variety of cup sizes are possible, it is preferred in one embodiment of the invention that the cup be in the order of 1.5 to 3 inches tall with an upper opening 12 having a diameter in the order of 1.25 to 3 inches. Even more preferably, particularly from the standpoint of maximum visual effect produced versus unit cost of the cup and contained confetti, it has been discovered that the cup should be in the order of 1.75 to 2.5 inches tall with an upper opening having a diameter in the order of 2 to 2.5 inches.

This size cup fits well in the hands of both children and adults, and while larger cup sizes are possible, it has been discovered that, in the FIG. 1 embodiment with one layer of confetti, the higher cost of a larger cup and the additional confetti contained therein is not offset by a correspondingly greater visual display. That is, this has been found to be particularly true for use of the invention in residences and party rooms having typical 8–10 foot ceilings. Thus, the foregoing cup sizes have been found to be important not only with respect to the economics, but also with respect to obtaining the maximum display of color and motion in rooms with the most common heights of ceilings. However, when intended for use in buildings with higher ceilings or outdoors, a second embodiment is preferred as will be subsequently described hereinafter.

It is also preferred that the annular wall 14 of the cup diverge outwardly in the upward direction, as illustrated in FIG. 1, such that the diameter of opening 12 is larger than that of bottom portion 16. That is, while cups having purely cylindrical walls extending upwardly at right angles to the bottoms of the cups are possible to be used with the present invention, it has been discovered that maximum visual effects are obtained with cups having upwardly diverging walls for reasons which will be more fully explained hereinafter. For example, it is preferred that annular wall 14 diverge from the vertical by an angle in the order of 1 to 20 degrees and, more preferably, an angle in the order of 5 to 15 degrees.

As further shown in FIG. 1, the top of cup 10 is provided with a cap or lid 18 which is preferably of the snap-on type such that the lid stays closed over the top of the cup until it is manually removed. Numerous types of snap-on lid designs are possible with the present invention, and solely for illustration purposes, FIG. 1 shows a design in which lid 18 has a flexible annular flange 20 which snaps over and around an annular rim 22 of the cup. Alternatively, it will be apparent that many other types of lids may be employed including lids which are secured to the cup by tape or adhesive. However, a snap-action cap is greatly preferred for reasons of cost, appearance and ease of opening so that the cap may be readily removed by all persons, particularly including small children, the elderly and the infirm.

As shown in FIGS. 1, 2 and 3, cup 10 is substantially filled with confetti 24. Confetti 24 is composed of individual pieces of lightweight material such as paper, tissue paper or plastic film, such as Mylar brand film. Most preferably, confetti 24 is composed of fireproof, biodegradable tissue paper having a thickness measured as eight to twenty pound test. As further shown in FIGS. 1–3, the individual pieces of confetti are of four-sided or tetragonal shape such as more fully described in co-pending application Ser. No. 08/051,355 now U.S. Pat. No. 5,352,148, incorporated herein by reference. In brief, the shape of the confetti may be rectangular as illustrated herein, or the shape may be that of a trapezoid, parallelogram or truncated triangle. In any of these shapes, the pieces are elongated in that their lengths are substantially greater than their widths, and preferably, their length to width ratio (L/W) is in the order of 1.75 to 7. The lengths of the pieces of confetti are cut slightly shorter than the vertical height of the cup, such as in the order of 1.5 to 3 inches, and preferably 2 to 2.75 inches. The widths of the individual pieces of confetti are preferably cut so as to maintain the L/W ratio of 1.75 to 7 and preferably the widths are in the order of one-half to one inch. As a result, the individual pieces of confetti fall through the air with their longitudinal axes extending horizontally, and they rotate about their horizontally extending, longitudinal axes such that they appear to flutter as they float slowly downwardly.

As illustrated in FIGS. 1–3, cup 10 is preferably filled with a pair of two separate stacks of confetti arranged with their longitudinal axes extending substantially vertically. For example, as best shown in FIGS. 2 and 3, the first stack 26 extends circumferentially about approximately 200 degrees of the circumference of the cup, and the second stack 28 extends radially inwardly from the circumference of the cup toward and beyond the center of the cup to the point at which the radially inner end of stack 28 engages the side edges of stack 26. This substantial filling of the cup is further shown in FIG. 3 wherein the bottom ends of stacks 26 and 28 are shown as almost completely covering the circular area of the bottom wall of the cup, and it is to be understood that, as used herein, the phrase "substantially filled" is intended to mean that degree of filling which results in the confetti pieces remaining vertically arranged as shown in FIG. 1.

As shown most clearly in FIGS. 1 and 2, the pieces of confetti positioned in or near the central portion of the cup extend vertically, while the pieces at or near the circumference of the cup extend substantially vertically but at a slightly outwardly diverging angle due to the fact of the outward divergence of annular wall 14. As will be further explained hereinafter, this orientation of the pieces of confetti, with those at the center being substantially vertical and those around the circumference being at a small angle to the vertical, results in the ejection of all of the pieces in substantially the vertical direction, but with the outer pieces having slightly divergent trajectories as the pieces are ejected from the cup. While other arrangements of stacks are possible, some of which will be later described herein, the two-stack embodiment of FIGS. 1–3 is preferred from the standpoint that, during manufacture, the insertion into the cup of only two stacks is required in order to substantially fill the cup which results in very quick loading of the cup.

Referring to FIG. 4, the use of the party favor to launch the confetti is as follows. The user removes lid 18 and holds cup 10 between the thumb and two or three fingers with open top 12 directed upwardly. For indoor use with relatively low ceilings, the hand and cup are then moved rapidly upwardly through a short vertical distance, such as about one foot, and the upward movement is then stopped suddenly. Because of the effective mass of the stacks of confetti, only a very short upward movement is necessary to create a momentum of the stacks such that, when the upward movement of the cup stops, the stacks of confetti continue upwardly and are ejected from the cup with a sufficient velocity and momentum to rise 6 or more feet into the air. This distance is more than sufficient for the confetti to reach the ceiling in a residence with a standard eight-foot ceiling whether the user is standing or seated. Also, this short, simple upward movement of the hand can be accomplished by either shoulder and/or elbow movement such that very effective, colorful and widely dispersed patterns of color and motion can be easily achieved by young children, the elderly and the infirm. In addition, the wide lateral dispersion of the confetti as it rises out of the cup and into the air is assisted by the fact that, with a cup having an upwardly divergent annular wall as previously discussed, the trajectories of the outer pieces of confetti are angled slightly outwardly as they rise in the air as schematically depicted in FIG. 4. This not only spreads the width of the display pattern, but the angled trajectories of the stacks assist in causing the stacks to separate more completely into individual pieces of confetti. Thus, the previously unattainable objects of achieving both maximum height and maximum dispersion, particularly in rooms with relatively low ceilings, and with a simple, nonstrenuous movement of the hand, are all achieved by the party favor of the present invention, and even with a small, two inch tall cup with a two inch top opening, over a thousand pieces of confetti may be launched in a colorful display.

As previously indicated, the embodiment discussed hereinabove with reference to FIGS. 1–4 is particularly preferred for use in homes and other indoor party rooms with relatively low ceilings; however, use of the present invention is in no way limited to such locations. For example, use of the invention outdoors, or in buildings with high ceilings, is equally applicable and, for such locations where it is desired to attain greater heights than those previously described, several alternative embodiments will be described as follows.

Referring to FIG. 5, a stack 30 of elongated tetragonal confetti is shown as being wrapped one or more times by an outer wrapper 32 which terminates with an outer end 33. Outer wrapper 32 may be a strip composed of the same material as the confetti pieces comprising stack 30, however wrapper 32 is shown in darker line in order to distinguish the wrapper from the confetti pieces. As disclosed in co-pending application Ser. No. 08/108,245, now U.S. Pat. No. 5,419,731, the complete specification of which is hereby incorporated by reference, wrapper 32 may be wrapped about the outer faces 34, 35 of the stack, extending parallel to the longitudinal axes of the pieces, and around both ends 36, 38 of the stack; the details of the wrapping method being disclosed in said co-pending application Ser. No. 08/108,245 now U.S. Pat. No. 5,419,973. Thus, it is to be understood that stacks wrapped by a wrapper entirely around the ends may be used in place of or with stacks which are unwrapped such as stacks 26, 28 previously described. That is, for example, stack 26 of the FIG. 1 embodiment may be unwrapped, while stack 28 may be replaced by a wrapped stack 30.

As further shown in FIG. 6, which is a top view of an alternate arrangement of stacks within a cup 10*a*, a first stack 40 is disposed so as to extend diametrically across the interior of the cup from one interior wall surface to the other. Stack 40 may be wrapped, or unwrapped as shown, and two additional stacks 42, 44 may be positioned on either side of stack 40 with stacks 42, 44 being unwrapped or wrapped as shown. Wrapping of the stacks holds the stacks together for a longer time period as the stacks rise in the air such that greater heights can be obtained. Therefore, when the party favors of the present invention are intended for use outdoors, or in rooms with high ceilings such as in auditoriums and theaters, some or all of the stacks in the cup are preferably wrapped. In addition, a particularly interesting display of confetti can be obtained by the use of one or more wrapped stacks in the same cup with one or more unwrapped stacks. This produces a unique dual level display wherein the unwrapped stacks reach a certain height and begin to float and flutter downwardly while the wrapped stacks continue and reach a greater height before beginning their fluttering decent downwardly from a position above the first display.

In addition to the use of wrapped and/or unwrapped stacks of confetti as just described, it has also been discovered that partially wrapped stacks may be used to give optimum effects particularly in rooms with relatively low or intermediate height ceilings. As shown in FIG. 7, a stack 46 of elongated tetragonal confetti is shown with an outer wrapping 48. Wrapping 48 extends around front face 50 of the stack, around upper end 52 of the stack, and around rear face 54 of the stack. However, the lower ends of wrapper 48 terminate at or near the bottom corners 56, 58 of the stack and do not extend fully around the bottom end 60 of the stack. Thus, stack 46 is effectively wrapped on three sides such that, when the stack is ejected from the cup into the air with upper end 52 leading in the essentially vertical trajectory, the partial wrapping holds the pieces of the stack together as the air flows around the wrapper covering the leading end 52 and along the sides of the wrapper which extend along the front and rear face 50, 54 of the stack. However, as the velocity of the stacks slows down, and/or if the stack hits a ceiling while the stack is still essentially wrapped, partial wrapper 48 opens fully and releases the pieces of confetti without having to unwind or unravel as in the case of the fully wrapped stacks previously described. Therefore, while the partially wrapped stack may not reach the maximum heights achieved by the fully wrapped stacks, the partially wrapped stack is extremely effective in the case of low and intermediate height ceilings in achieving a sudden and wide burst pattern of the confetti pieces.

The partially wrapped stack or bundle 46 may be manufactured in several ways. However, the preferred method of manufacture is to first fully wrap the stack with the wrapper extending one or more times about the complete bundle as shown and described with reference to FIG. 5. Preferably, this is accomplished according to the method of manufacture as described in co-pending application Ser. No. 08/108,245 now U.S. Pat. No. 5,419,731. Thereafter, the portion of the wrapper extending about lower end 60 may be ruptured, torn or cut, either manually or by a cutter, so as to expose lower end 60 while maintaining the wrapper about the other three sides of the bundle. The partially wrapped bundle is then held by the front and rear faces of the wrapper so that the wrapper remains in place around the stack as the partially wrapped bundle is inserted into a cup with the unwrapped, lower end 60 positioned at the bottom of the cup from which it may be ejected as previously described. It should also be noted that excellent results have been obtained by the use of a single stack, such as stack 40 of the FIG. 6 embodiment, with such stack fully or partially wrapped and inserted as just described. This embodiment has the added advantage that only a single stack need be inserted in each cup during manufacture which substantially lowers the manufacturing time and cost.

Reference is now made to FIG. 8 which illustrates yet another preferred embodiment of the present invention. This embodiment is particularly effective for use outdoors or in large rooms with high ceilings where a large display pattern is desired. In this embodiment, a significantly taller cup 10*b* is used such that two or more layers 62, 64 of confetti stacks may be contained in the cup. While layer 64 may be stacked directly on top of layer 62, particularly if the stacks of confetti are fully or partially wrapped, it is preferred to place a divider 66 between the layers to retain the layers in segregated form during shipment. Divider 66 may be a circular disc of any lightweight material, such as paper, cardboard or other thin material having a diameter smaller than that of the midsection of the cup. Each of the upper and lower layers 62, 64 may include one or more unwrapped stacks or wrapped bundles of the various embodiments previously described. The operation of this embodiment is essentially the same as that explained above, except that a larger volume and wider variety of wrapped, unwrapped and partially wrapped stacks may be contained in and ejected from cup 10*b*, and the vertical movement of the hand and cup should extend through more than one foot so as to achieve maximum height and the widest dispersion pattern. For example, over five thousand pieces of confetti may be launched from a cup having a height in the order of 3 to 9 inches, with the top opening diameter in the order of 3 to 5 inches, and the confetti may easily reach 20 feet or more and can create a dispersion of confetti over an area of 500 feet or more.

From the foregoing description of several preferred embodiments, it will be apparent that the present invention provides an extremely simple and low cost device for launching confetti, which device can be easily shipped without damage to the launching ability of the device, and which device can be used by young and old alike to create large and effectively dispersed displays of confetti which can reach great heights without requiring any dexterity and with a nonstrenuous movement of the hand. It will also be apparent that numerous variations will be obvious to those skilled in the art and that the foregoing description of several preferred embodiments of the invention is intended to be illustrative of the principles of the invention rather than limiting thereof, and that the invention is not intended to be limited other than as set forth in the following claims interpreted under the doctrine of equivalents.

What is claimed is:

1. A party favor capable of projecting confetti upwardly into the air comprising:

(a) a cup having a bottom, an open top and an annular wall extending between said bottom and said open top;

(b) a large plurality of pieces of confetti positioned in said cup, at least some of said pieces of confetti being aligned in a stack and said stack being wrapped by a wrapper around said stack; and (c) a removable cover extending over said top whereby said pieces of confetti are retained in said cup until said cover is removed by the user and the confetti is manually ejected from the cup and projected upwardly into the air by upward movement of the hand.

2. The party favor of claim 1 wherein said stack has a length and a pair of spaced-apart ends, and said wrapper extends parallel to said length and around both of said ends of said stack.

3. The party favor of claim 1 wherein said stack has two elongated sides and a pair of spaced-apart ends, and said wrapper extends around said two elongated sides of said stack and around at least one of said ends of said stack.

4. The party favor of claim 3 wherein said wrapper extends around said two elongated sides and around only one of said ends of said stack.

5. A party favor capable of projecting confetti upwardly into the air comprising:

(a) a cup having a bottom, an open top and an annular wall extending between said bottom and said open top, said cup having a central axis extending between said bottom and said top;

(b) a large plurality of pieces of confetti positioned in said cup, said confetti pieces having tetragonal shapes and having lengths and widths, said confetti pieces being oriented in said cup with their lengths extending substantially parallel to each other and to said central axis; and (c) said plurality of confetti pieces being sufficient such that said cup is substantially filled with said confetti pieces such as to maintain said confetti pieces substantially parallel to said central axis prior to use and such that, upon rapid upward movement of said cup by the user, said tetragonal confetti pieces are projected upwardly into the air with said lengths extending in substantially vertical directions.

6. The party favor of claim 5 wherein the ratios of said lengths to widths are in the order of 1.75 to 7.

7. The party favor of claim 5 wherein the height of the cup is in the order of 1.5 to 3 inches and the diameter of said open top is in the order of 1.25 to 3 inches.

8. The party favor of claim 5 wherein said annular wall of said cup diverges outwardly in the direction from said bottom to said top.

9. The party favor of claim 8 wherein said annular wall of said cup diverges outwardly in the direction toward said top by an angle of divergence in the order of 1 to 20 degrees.

10. The party favor of claim 9 wherein said angle of divergence is in the order of 5 to 15 degrees.

11. The party favor of claim 5 wherein some of said plurality of pieces of confetti are aligned in a first stack, and others of said plurality of pieces are aligned in a second stack.

12. The party favor of claim 11 wherein said first stack extends about a major portion of the interior circumference of said cup, and said second stack extends along a radius of said cup between said annular cup wall and said first stack.

13. The party favor of claim 5 wherein said plurality of pieces of confetti comprise at least two separate layers of confetti pieces, one of said layers being in contact with said bottom of said cup, and another of said layers being positioned between said first layer and said top of said cup.

14. The method of manufacturing a party favor comprising the steps of:

(a) forming a plurality of pieces of confetti, said pieces of confetti having lengths and widths and said lengths being greater than said widths;

(b) forming at least one stack of aligned pieces of confetti;

(c) wrapping said at least one stack to form a wrapped bundle of pieces of confetti;

(d) inserting said wrapped bundle into a cup having an open top; and (e) closing said cup with a removable cover extending over said open top.

15. The method of claim 14 wherein said wrapped bundle is inserted into said cup with the lengths of said pieces of confetti extending substantially parallel to each other and substantially perpendicularly to the plane of said cover.

16. Party favor means for launching confetti upwardly into the air comprising:

(a) a cup having a bottom, an open top and an annular wall extending between said bottom and said top, said cup having a central axis extending between said bottom and said top;

(b) a large plurality of pieces of confetti positioned in said cup, each of said confetti pieces having a tetragonal shape, a length and a pair of faces, said plurality of pieces being aligned in face-to-face relationship with each other and with their lengths extending substantially parallel to said central axis;

(c) said plurality of confetti pieces substantially filling said cup such that said confetti pieces remain in said face-to-face relationship and remain substantially parallel to said central axis so long as said confetti pieces remain in said cup; and (d) a removable cover closing said open top of said cup.

17. The party favor means of claim 16 wherein said removable cover is a snap-action lid.

18. The party favor means of claim 16 wherein said annular wall diverges outwardly in the direction toward said open top by an angle of divergence in the order of 0 to 20 degrees.

* * * * *